United States Patent [19]

Salmond

[11] 4,348,677

[45] Sep. 7, 1982

[54] COMMON APERTURE DUAL MODE SEEKER ANTENNA

[75] Inventor: William E. Salmond, Claremont, Calif.

[73] Assignee: General Dynamics, Pomona Division, Pomona, Calif.

[21] Appl. No.: 51,471

[22] Filed: Jun. 25, 1979

[51] Int. Cl.[3] ..... H01Q 1/00

[52] U.S. Cl. ..... 343/729; 343/798; 343/840

[58] Field of Search ..... 343/726, 727, 729, 730, 343/779, 895

[56] References Cited

U.S. PATENT DOCUMENTS

| | | |
|---|---|---|
| 2,049,070 | 7/1936 | Mathieu . |
| 2,895,127 | 7/1959 | Padgett . |
| 2,920,174 | 1/1960 | Haagensen . |
| 2,972,743 | 2/1961 | Svensson et al. . |
| 3,114,149 | 12/1963 | Jessen, Jr. . |
| 3,165,749 | 1/1965 | Cushner . |
| 3,242,485 | 3/1966 | Astheimer . |
| 3,394,378 | 7/1968 | Williams et al. . |
| 3,427,625 | 2/1969 | Kazimi . |
| 3,445,850 | 5/1969 | Stegen . |
| 3,820,117 | 6/1974 | Hall et al. . |
| 3,820,118 | 6/1974 | Hall . |
| 3,907,565 | 9/1975 | Burton et al. . |
| 4,095,230 | 6/1978 | Salmon et al. . |

*Primary Examiner*—Theodore M. Blum

*Attorney, Agent, or Firm*—Neil F. Martin; Edward W. Callan; Edward B. Johnson

[57] ABSTRACT

The disclosed common aperture seeker antenna includes a parabolic array of crossed dipoles. This array is substantially reflective for radiated electrical signals in one band, and substantially transmissive for radiated electrical signals outside of that band. A monopulse (four-element) waveguide feed is rigidly positioned on the concave side of the parabolic array at the focal point thereof. The parabolic reflector antenna operates in the one band to provide a high gain active system for accurate tracking of targets. A planar spiral antenna is rigidly positioned on the convex side of the parabolic array in axial alignment with the parabolic reflector antenna. This wideband antenna operates over a multioctave frequency band below that of the one band to provide a low gain system for passive tracking of targets. The two antenna systems coexist in such a manner that each utilizes the available aperture to its fullest extent.

7 Claims, 2 Drawing Figures

COMMON APERTURE DUAL MODE SEEKER ANTENNA

BACKGROUND OF THE INVENTION

This invention relates to antenna systems and, more particularly, to antenna systems for use in military defense missiles. The function of these missiles is to detect, locate, and destroy enemy targets.

To enhance the missile's effectiveness, it is often desirable to have operational capability in both active and passive modes. In the passive mode, the antenna simply "listens" for any signals which may be radiated by the target. This operation is best performed by a low gain wide band antenna. Conversely, in the active mode the antenna transmits signals which are reflected by the target and subsequently received by the same antenna. This operation is best performed by a high gain narrow band antenna.

An "all-passive" antenna system which provides both wide and narrow beam capabilities (for initial target acquisition and subsequent high accuracy tracking) is described in U.S. Pat. No. 4,095,230, issued June 13, 1978 to the present applicant. The present invention is a variation of the apparatus there described. Basically, that apparatus included a low gain, wide band antenna which also functioned as a reflector for the high gain, narrow beam antenna system. By comparison, in the present invention, the low gain wide band antenna performs no signal reflection function. Instead, that function is performed by a frequency sensitive parabolic dish which lies between the low gain, wide band antenna and a waveguide feed. The waveguide-fed reflector antenna allows the use of a high power transmitter, which results in extended range tracking capability.

This dish is substantially transmissive for frequencies at which the low gain wide band antenna system operates; and is substantially reflective for frequencies at which the high gain narrow band antenna operates. Thus, in operation, initial target detection is performed by receiving signals with the low gain, wide band antenna which have passed through the parabolic array, and the subsequent terminal mode tracking of the target is achieved by transmitting and receiving signals that are reflected by the array.

BRIEF DESCRIPTION OF THE DRAWINGS

The various objects and features of the invention will best be understood by reference to the following detailed description when read in conjunction with the accompanying drawings, wherein.

DETAILED DESCRIPTION

Figure 1:
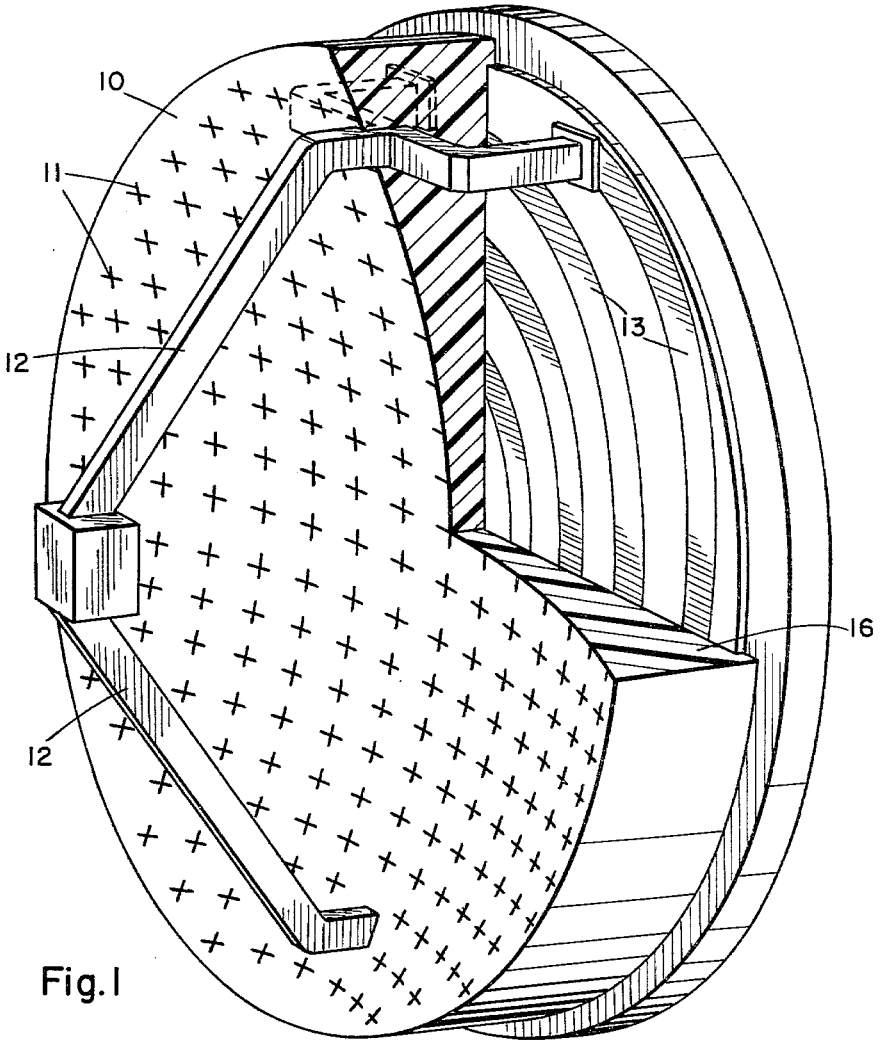
FIG. 1 is a pictorial view of a preferred embodiment of a common aperture seeker antenna constructed according to the invention.

A preferred embodiment of a common aperture seeker antenna will now be described with reference to FIG. 1. Basically, the preferred embodiment includes a parabolic array 10 of crossed dipoles 11, a monopulse waveguide feed 12, and a planar spiral antenna 13. Items 10 and 12 comprise a parabolic reflector antenna system which operates in a relatively high frequency band in comparison to antenna 13. Preferably, the center frequency $f_0$ of the frequency band in which the parabolic reflector operates is at least twice the highest frequency of the band in which antenna 13 operates.

Due to the presence of the crossed dipoles 11, array 10 operates to reflect the high frequency signals from feed 12 while at the same time being effectively transparent to the low frequency signals from antenna 13. This result is best achieved by constructing the length of dipoles 11 equal to one-half wavelength of a signal at frequency $f_0$. Also the center-to-center spacing of each of the crossed dipoles is preferably set to approximately one half wave wavelength at frequency $f_0$. By these constraints, the FIG. 1 antenna makes use of the principle that backscatter from a shorted dipole is at a maximum at its half wave resonant frequency. This principle applies when the incident radiation is linearly polarized and aligned with the axis of the dipole. Two such dipoles set orthogonal to each other in the shape of a cross, as in FIG. 1, make the backscatter independent of polarization.

Thus, array 10 behaves essentially like a uniform reflecting surface to all polarizations at frequencies near $f_0$; and behaves like an essentially transparent surface to all polarizations below $f_0/2$. In the passive mode of operation, antenna 13 receives signals in the low frequency band through array 10. While in the active mode, antenna 12 transmits and receives signals in the high frequency band, and those signals are reflected by array 10. The broadband spiral antenna system is utilized for target acquisition and passive homing, while the active system is utilized for more accurate terminal guidance against non-radiating targets.

The width of the frequency band over which array 10 is reflective depends to a great extent on the length to width ratio of the individual arms in the crossed dipoles 11. In general, this bandwidth increases as the length-to-width ratio decreases. For example, with a length/-width ratio of 7, transmission losses do not fall below one-half dB until the frequency of 0.33 $f_0$; whereas with a length/width ratio of 133, transmission losses fall below one-half dB at a frequency of 0.55 $f_0$. Additional details on how bandwidth varies with length/width ratios may be found in the publication entitled "A Frequency Sensitive Cassegrainian Subreflector" by Frank O'Nians presented at the 10th Annual Symposium on Antennas and Propagation at the University of Illinois.

Figure 2:
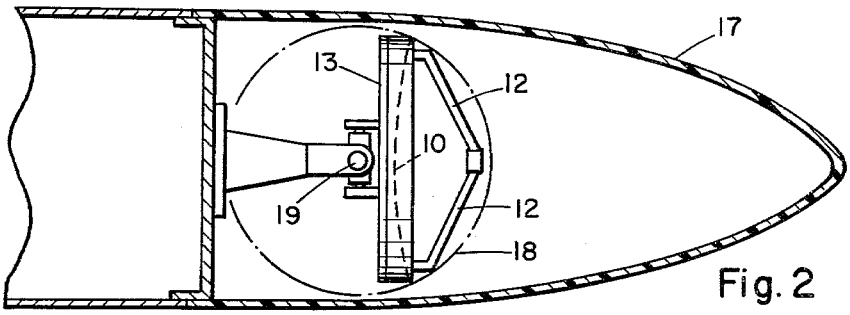
FIG. 2 is a schematic diagram of the FIG. 1 antenna gimballed within a missile's radome.

Also in the illustrated embodiment, array 10 is held in place by a low loss dielectric foam 16; and antenna 13 is backed by an RF-absorber-filled cylindrical cavity to maximize bandwidth and to insure one way radiation. The entire arrangement is then mounted in a gimballed fashion in a radome 17 as illustrated in FIG. 2. There, the space envelope within which the gimballed seeker antenna is confined is indicated via reference numeral 18. This space constraint is met by rotating the seeker antenna on the gimbal axis 19.

A preferred embodiment of the invention has now been described in detail. In addition, various changes and modifications can be made to these details without departing from the nature and spirit of the invention. Thus, it is to be understood that the invention is not limited to said details but is defined by the appended claims.

Having described my invention, I now claim:

1. A common aperture seeker antenna comprised of:
   a parabolic array of crossed dipoles being substantially reflective for radiated electrical signals in a band centered at a predetermined frequency $f_0$, and being substantially transmissive for radiated electrical signals outside of said band;

a monopulse waveguide feed fixedly positioned on the concave side of said parabolic array at the focal point thereof for operating at frequencies within said band; and a planar spiral antenna fixedly positioned on the convex side of said parabolic array in axial alignment with said first antenna for operating at frequencies outside of said band.

2. A common aperture antenna according to claim 1, wherein the individual dipoles of said array have a length-to-width ratio of at least 5.

3. A common aperture antenna according to claim 1, wherein said planar spiral antenna operates only at frequencies below $f_0/2$.

4. A common aperture antenna according to claim 1, and further including means for gimballing said parabolic array, said waveguide feed and said planar spiral antenna within a radome.

5. A common aperture antenna according to claim 4, wherein said planar spiral antenna is backed with an RF-absorber-filled cylindrical cavity.

6. A common aperture antenna according to claim 5, wherein said planar spiral antenna has four evenly spaced inter-leaved spiral arms.

7. A common aperture seeker antenna comprised of:

a waveguide-fed parabolic reflector antenna for transmitting and receiving signals in a relatively high frequency band;

a planar spiral antenna in axial alignment with and spaced apart from said high frequency antenna for receiving signals in a second frequency band outside of said first frequency band; and a parabolic array of crossed dipoles lying between said antenna and in axial alignment therewith for reflecting substantially all signs in said first band, and for passing substantially all signals in said second band.

* * * * *